US006282851B1

(12) United States Patent
Beaton

(10) Patent No.: US 6,282,851 B1
(45) Date of Patent: Sep. 4, 2001

(54) DOOR FRAMES

(76) Inventor: Ross James Beaton, 59 Draper Street, Ocean Grove, Victoria, 3226 (AU)

( * ) Notice: Subject to any disclaimer, the term of this patent is extended or adjusted under 35 U.S.C. 154(b) by 0 days.

(21) Appl. No.: 09/423,145

(22) PCT Filed: May 6, 1997

(86) PCT No.: PCT/AU97/01512

§ 371 Date: Feb. 14, 2000

§ 102(e) Date: Feb. 14, 2000

(87) PCT Pub. No.: WO97/42390

PCT Pub. Date: Nov. 13, 1997

(30) Foreign Application Priority Data

May 6, 1996 (AU) ..... PN 9670

(51) Int. Cl.[7] ..... E06B 1/04

(52) U.S. Cl. ..... 52/204.1; 52/217; 52/443; 52/656.4; 52/656.7; 49/505

(58) Field of Search ..... 52/204.1, 210, 52/217, 443, 656.1, 656.2, 656.4, 656.7; 49/505

(56) References Cited

U.S. PATENT DOCUMENTS

| | | | | |
|---|---|---|---|---|
| 3,364,623 | | 1/1968 | Sklar . | |
| 4,698,944 | * | 10/1987 | Wilkins, Jr. | 52/217 X |
| 4,813,204 | * | 3/1989 | Rentschler | 52/217 |
| 4,986,044 | * | 1/1991 | Funari | 52/213 |
| 5,220,748 | * | 6/1993 | Chadbourne | 49/505 |
| 5,528,869 | * | 6/1996 | Boomer et al. | 52/212 |
| 5,581,953 | * | 12/1996 | Ruff | 49/504 |
| 5,619,823 | * | 4/1997 | Ruff et al. | 49/504 |
| 5,711,120 | * | 1/1998 | Karpen | 52/212 |
| 6,041,565 | * | 3/2000 | Reitz et al. | 52/656.4 |

FOREIGN PATENT DOCUMENTS

| | | |
|---|---|---|
| 67111/74 | 10/1974 | (AU) . |
| 56314/96A | 1/1997 | (AU) . |
| 524049A | 7/1972 | (DE) . |
| 128076A | 1/1962 | (FR) . |
| 1560548A | 2/1969 | (FR) . |
| 2127225A | 10/1972 | (FR) . |

* cited by examiner

*Primary Examiner*—Beth A. Stephan
*Assistant Examiner*—Brian E. Glessner
(74) *Attorney, Agent, or Firm*—Harness, Dickey & Pierce, P.L.C.

(57) ABSTRACT

A door frame comprises opposed door jambs and a door head, with the jambs and head each being formed from a metal section (6) of channel-shape having a base wall (8) which carries a door stop (12) and opposed side walls (10) of a width such that when the section (6) is applied to a door opening within a wall with plasterboard sheeting (16) on the wall around the opening, the opposed side walls (10) of the section (6) will overlap and lie closely adjacent to the outer surface of the plasterboard (16) with the edge of the plasterboard (16) being concealed with the interior of the section (6), the opposed side walls (10) being perforated to permit a skim coat of plaster to be applied over the side walls (10) and adjacent part of the palsterboard (16) to conceal the presence of the side walls. In one embodiment the metal section is formed from two components which engage with a friction fit to provide width-adjustment of the section to suit walls of different width.

3 Claims, 5 Drawing Sheets

DOOR FRAMES

The present invention relates to door frames and more particularly to a metal section for use as the door jamb and door head of a frame and which simplifies the installation of the frame.

Conventionally, door frames used in domestic dwellings and similar constructions comprising walls lined with plasterboard sheeting are secured to studs defining the door opening. The inside faces of the door jambs and door head of the frame abut against the edges of plasterboard sheeting on the wall within which the door opening is formed and the joint between the plasterboard and door frame is concealed by architrave applied to the door frame and overlapping the adjacent part of the plasterboard. The architrave is applied at both sides of the door frame and is installed by being cut to size, mitred, and then nailed to the door frame. Subsequently, the nail holes have to be filled, and the architrave primed and painted.

The present invention relates to a door frame which obviates the need for an architrave and hence leads to a reduction in the cost of installing the door frame.

According to the present invention, there is provided a door frame comprising opposed door jambs and a door head, said jambs and said head each being formed from a metal section of channel-shape having a base wall which carries a door stop and opposed side walls of a width such that when the section is applied to a door opening within a wall with plasterboard sheeting on the wall around the opening, the opposed side walls of the section will overlap and lie closely adjacent to the outer surface of the plasterboard with the edge of the plasterboard being concealed with the interior of the section, the opposed side walls being perforated to permit a skim coat of plaster to be applied over the side walls and adjacent part of the plasterboard to conceal the presence of the side walls.

Advantageously, the opposed side walls are offset inwardly relative to the base wall of the section whereby the section provides adjacent the base of each side wall an outwardly projecting lip which defines an edge for the skim coat.

The section may be a one-piece component of fixed width, or alternatively a two-piece component which is adjustable in width.

The invention also provides a metal section for use in forming the door frame defined above, said section being of channel-shape and opposed side walls perforated with a multiplicity of apertures to permit application of the skim coat.

Preferably, a door stop also of channel-section is carried by the base wall of the section. Advantageously, the entire section including the door stop is roll-formed from metal strip.

The invention also provides a method of installing a door frame to a door opening comprising providing door jambs and a door head as defined above, applying the door jambs and door head to studding around the door opening with the opposed side walls overlapping the edge portion of plasterboard around the door opening, and applying a skim coat over the exposed side walls of the jambs and head to conceal the presence of the side walls.

Embodiments of the invention will now be described, by way of example only, with reference to the accompanying drawings, in which.

Figure 1:
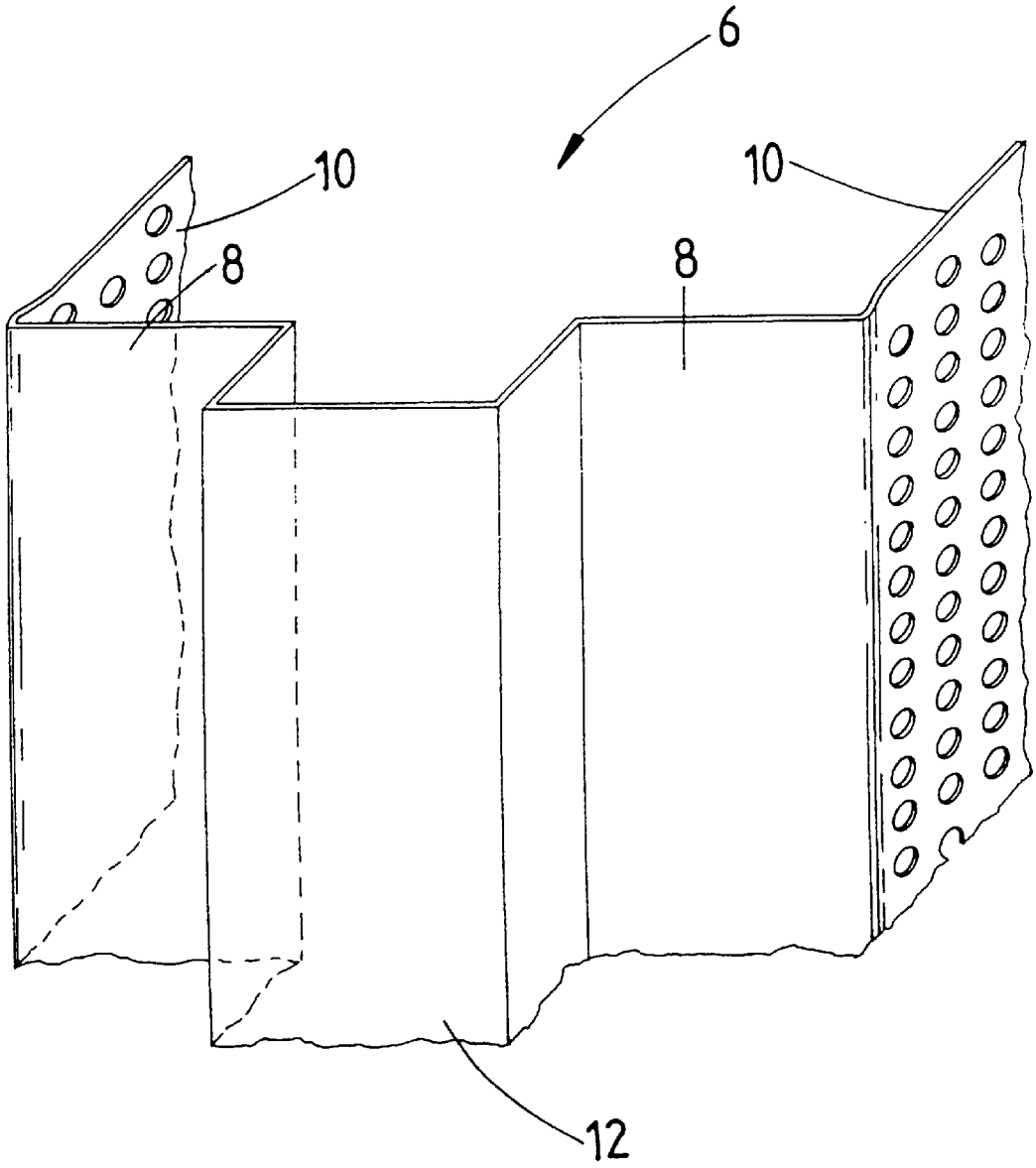
FIG. 1 is a fragmentary perspective view showing part of a length of metal section in accordance with a first embodiment of the invention used to form the door jambs and door head of a door frame.
Figure 2:
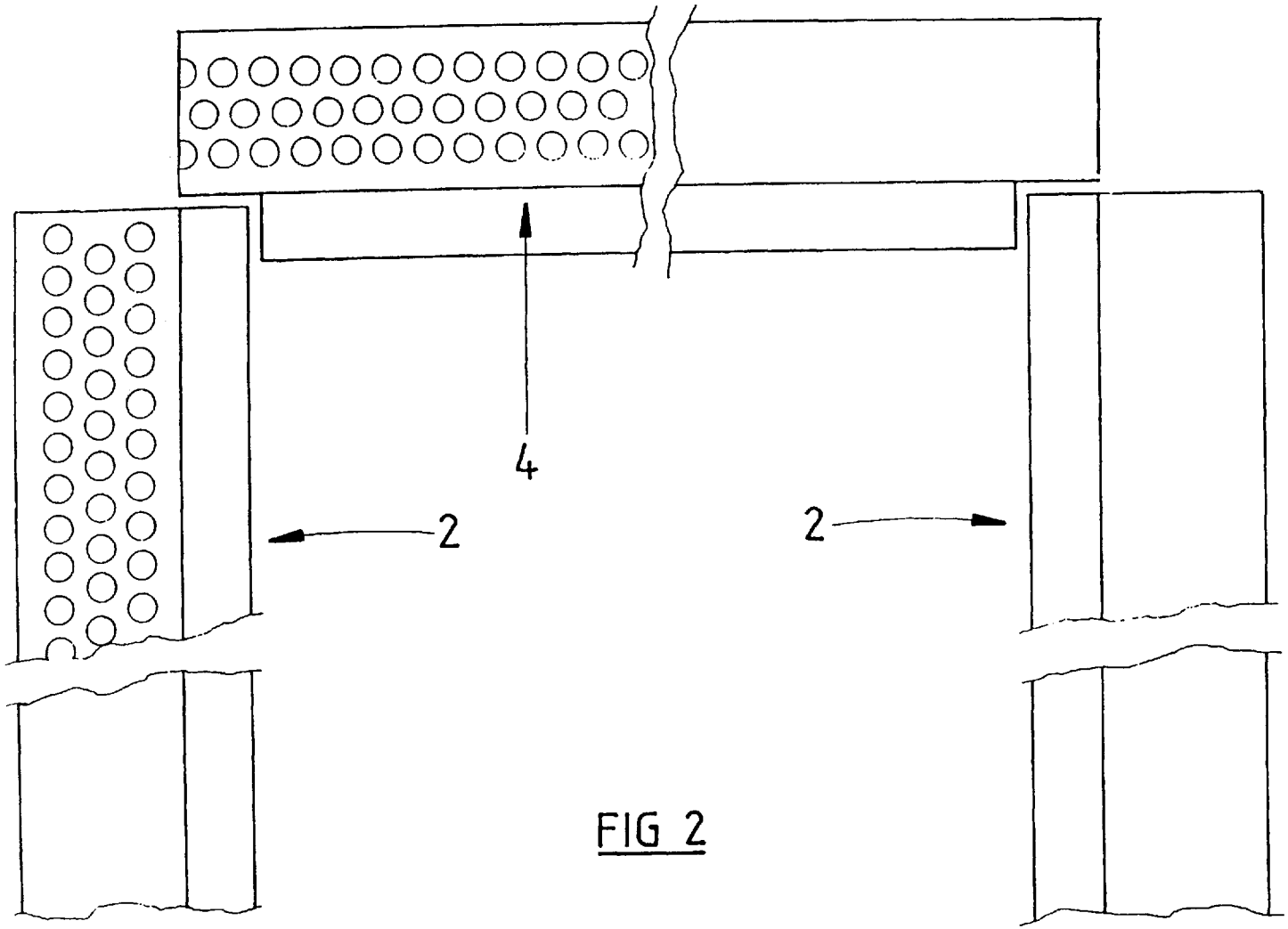
FIG. 2 is a fragmentary side view showing the jambs and head of the installed frame.

As shown in the accompanying drawings a door frame consists of opposed door jambs 2 and a door head 4 each constructed from the same basic metal section 6 which is shown in FIG. 1. The basic metal section 6 is of channel form which provides a base wall 8 and opposed side walls 10. A smaller channel 12 extends outwardly from the base wall 8 to define the door stop. The opposed side walls 10 are perforated throughout their length with a multiplicity of perforations, the purpose of which is described below.

The door frame is installed by applying the jamb and head sections 2,4 to the studding 14 (FIG. 3) around the door opening. It will be noted from FIG. 3 that the width of the metal section 6 is such that the spacing between the opposed side walls 10 of the section is slightly larger than the width of the studding 14 plus the plasterboard sheeting 16 applied to the opposite sides of the studding 14 so that the side walls 10 of the section will overlap the edge portion of the plasterboard 16 and lie closely adjacent to the outer surface of the plasterboard at each side of the door opening. Accordingly, the joint between the edge of the plasterboard 16 and the metal section 6 forming the door frame is concealed within the interior of the door frame.

Figure 3:
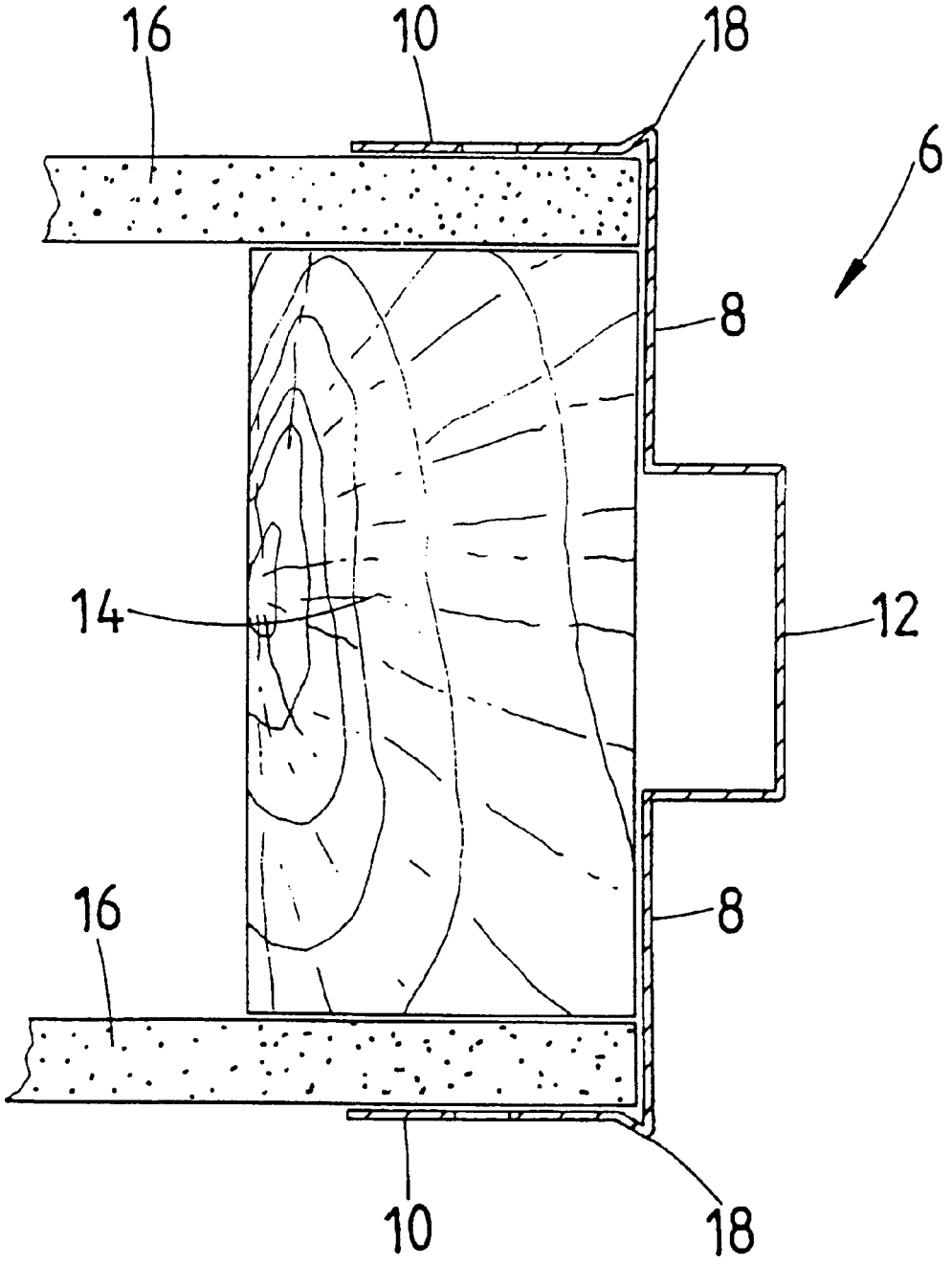
FIG. 3 is a cross-section showing the manner in which the metal section acts to conceal the edge of plasterboard sheeting around the door opening.

It will also be noted from FIG. 3 that the perforated side walls 10 of the metal section are slightly inwardly offset from the base wall 8 of the section so as to define a laterally-projecting lip 18 at each edge of the section. The perforations of the two side walls 10 are such as to enable a skim coat of plaster to be applied over the side walls 10 and adjacent part of the plasterboard in order to conceal the presence of the side walls 10. The small inwards inset of the side walls 10 from the base wall 8 of the section forming the door frame accommodates the thickness of the skim coat which terminates smoothly against the outer face of the projecting lip 18.

The skim coat around the door frame can be applied very quickly and inexpensively and will only marginally add to the cost of plastering. The added cost resulting from this will be significantly less than the cost of providing, installing and painting architrave in a conventional construction.

The metal section for forming the door frame can readily be produced from metal strip by roll-forming and then stamping to form the perforations in the opposed side walls. The formed and perforated metal strip can be cut to standard lengths in the factory so that door frame kits consisting of two jambs and a head of standard length and width can be supplied to installers.

It is to be noted that the width of one of the portions of the base wall 8 between the channel 12 and the adjacent edge of the section will be of a size to suit a standard door and different sections can be produced in which this dimension differs in order to suit standard doors of different thickness. Similarly, a range of sections of different overall width can be produced for use with different depths of wall. Alternatively, however, the section can be of two-part construction to permit a single section to be adjustable in width on site. An embodiment of the section with capability for width adjustment will now be described with reference to FIG. 4.

Figure 4:
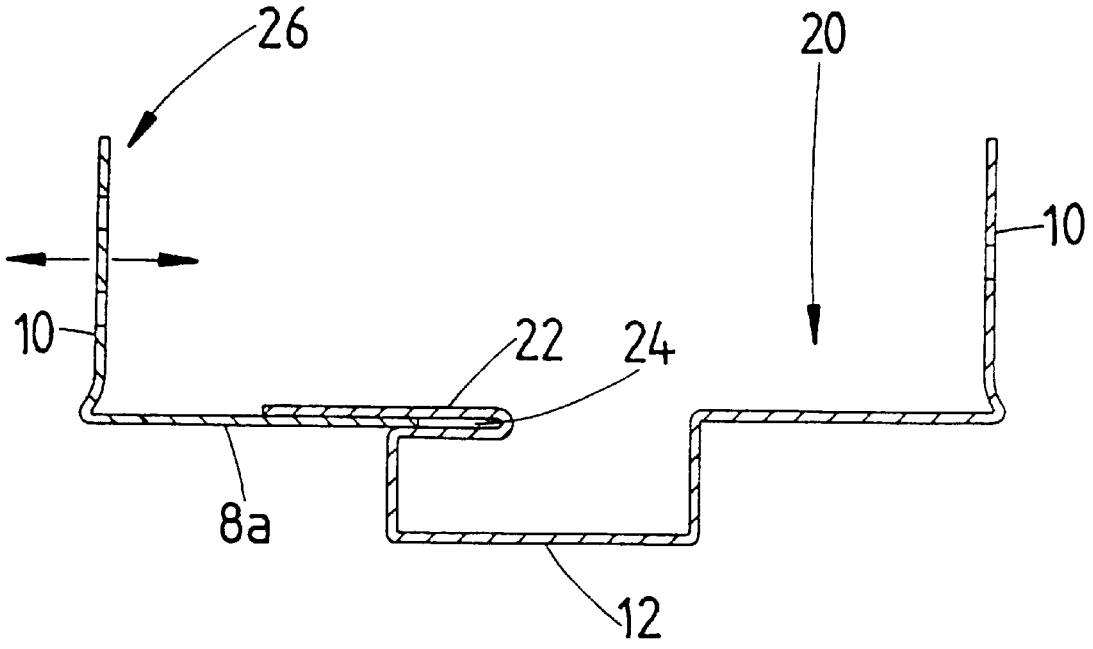
FIG. 4 is a cross-section showing an embodiment of variable width.

As shown in FIG. 4 the adjustable width section comprises a primary component 20 which is shaped to provide one of the two perforated side walls 10 and the door stop 12. Adjacent the edge of the door stop 12 remote from the side wall 10, the component 20 is shaped with a return fold 22 which defines a narrow slot 24. A secondary component 26 of the section is of substantially L-shaped form to provide the other perforated side wall 10 and a base wall portion 8*a* which locates with a friction fit within the slot 24 in the primary component 20. As will be apparent, by sliding the secondary section 26 laterally relative to the primary section 20 so that the base wall portion 8*a* extends into the slot 24 to a greater or lesser extent, the overall width of the section can be varied and the section will be retained at the selected width by friction engagement between the two components 20,26.

Figure 5:
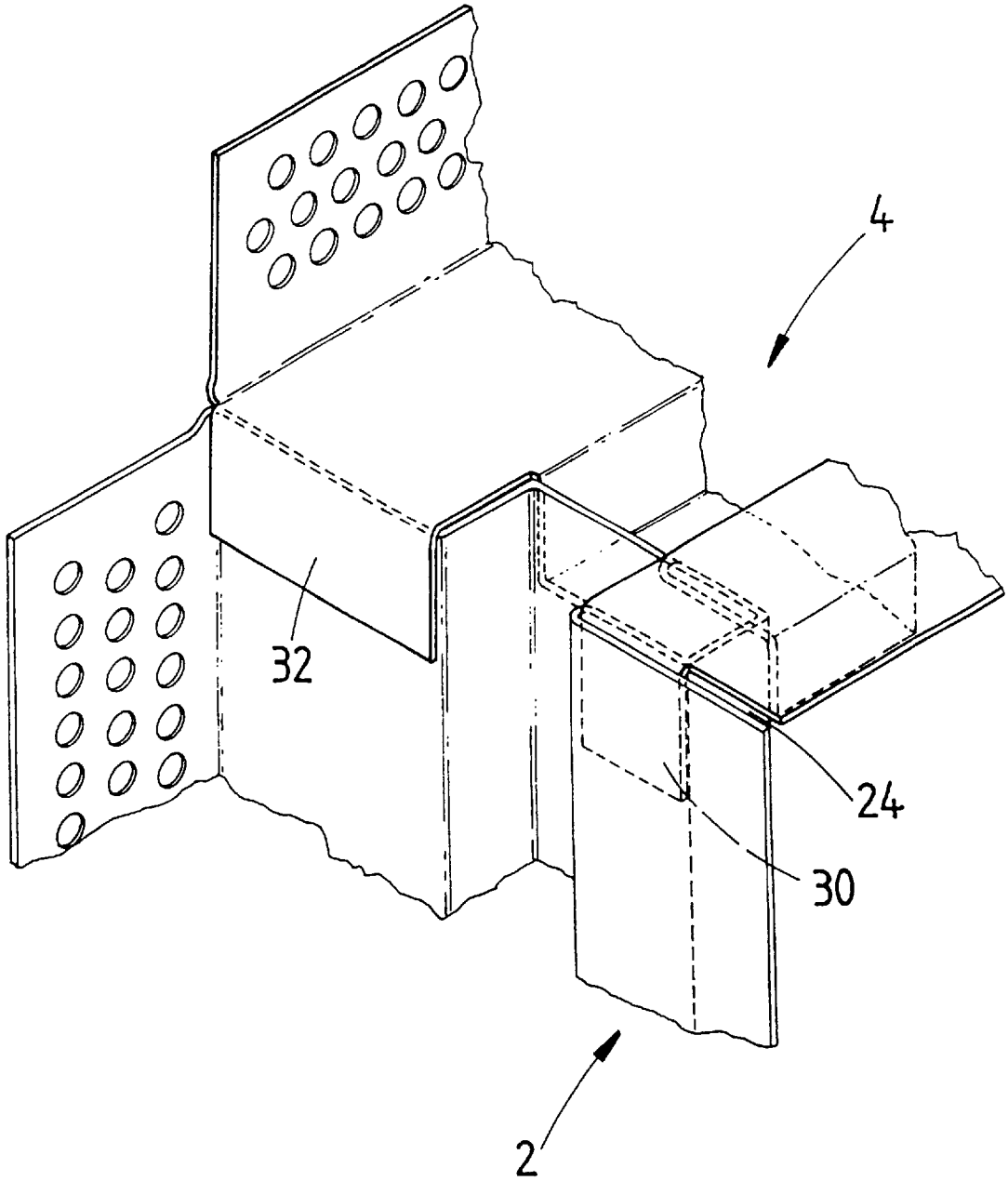
FIG. 5 is a schematic perspective view showing a clipping system between the head section and an adjacent jamb section.

It is to be noted that the slot 24 which receives the secondary component to facilitate width adjustment, can also act to receive a clipping lug to facilitate mutual attachment between the head section and adjacent jamb sections of the overall frame. This is illustrated schematically in FIG. 5 wherein a first clipping lug 30 at the end of the head section 4 engages within the upper end of the slot 24 in the jamb section 2 with friction engagement, and a second clipping lug 32 of the head section 4 engages behind the adjacent base wall portion of the jamb section 2 with friction engagement, a similar pair of lugs being provided at the opposite end of the head section 4 for engagement with the other jamb section 2. In FIG. 5, only the primary component of each section is illustrated, the secondary component having been omitted for clarity. In the end of the slot 24 which receives the lug 30, the base wall portion 8*a* of the secondary component is cut-away to prevent interference with the lug 30. It is of course to be understood that in an alternative arrangement the clipping lugs 30,32 may be similarly formed at the upper end of each jamb section 2 to engage with the head section 4.

Although in the embodiment of FIGS. 4 and 5, the slot 24 in the primary component serves to receive with a friction fit the base wall portion 8*a* of the secondary component and also a clipping lug of the adjacent head or jamb, a section of constant width can also be formed with a corresponding slot in order to receive a clipping lug during assembly of the frame in the manner just described.

Although as described, the clipping lugs are integral with the head or jamb section, in an alternative arrangement two pairs of clipping lugs may be formed on a separate clip engageable with both the head section and adjacent jamb section.

Each of the embodiments described can be produced relatively inexpensively by roll-forming metal strip. The laterally-projecting lips of each edge of the section define rolled edges which act to reinforce the section against damage to the exposed edge of the section and also to the adjacent edge of the plaster skim coat.

The embodiment has been described by way of example only and modifications are possible within the scope of the invention.

What is claimed is:

1. A door frame comprising:

opposed door jambs, and a door head, said jambs and said head each being formed from a metal section of channel shape having a base wall which includes a door stop and opposed side walls, said side walls being of a width such that when said metal section is applied to a door opening within a wall having plasterboard sheeting on the wall around the opening, said opposed side walls of said metal section overlap and lie closely adjacent to the outer surface of the plasterboard with the edge of the plasterboard being concealed within the interior of said metal section, each said opposed side wall being perforated with a multiplicity of perforations over its entire area to permit a skim coat of plaster to be applied over each said opposed side wall and the adjacent part of the plasterboard, the entirety of each said opposed side wall being offset inwardly relative to said base wall of said metal section whereby said metal section provides, adjacent said base wall, an outwardly projecting lip which defines an edge for the skim coat which thereby conceals substantially the entirety of each said opposed side wall, said metal sections being adjustable in width to accommodate the thickness of the wall and each said metal section comprising a first metal component shaped from a metal strip material to provide one of said opposed side walls and said door stop and a lateral slot adjacent to an edge of said door stop, and a second metal component shaped from a metal strip material to provide the other of said opposed side walls and a portion of said base wall which engages with a friction fit within said lateral slot to permit width adjustment by relative displacement between said opposed side walls of said first metal component and said second metal component.

2. A door frame according to claim 1 wherein said metal strip material forming said first component is folded to form said lateral slot between opposed surface portions of said folded metal strip material.

3. A door frame according to claim 2 further comprising clip means for coupling the respective ends of said door head to the adjacent end of a corresponding said door jamb, said clip means comprising a clipping lug carried by one of said door head or said door jamb and engaged with a friction fit in said lateral slot of the other of said door head or said door jamb.

* * * * *